US008872126B2

(12) United States Patent
Umeda et al.

(10) Patent No.: US 8,872,126 B2
(45) Date of Patent: Oct. 28, 2014

(54) TARGET SUPPLY DEVICE AND EXTREME ULTRAVIOLET LIGHT GENERATION APPARATUS

(71) Applicant: Gigaphoton Inc., Oyama-shi, Tochigi-ken (JP)

(72) Inventors: Hiroshi Umeda, Oyama (JP); Toshiyuki Hirashita, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 14/188,428

(22) Filed: Feb. 24, 2014

(65) Prior Publication Data

US 2014/0239203 A1 Aug. 28, 2014

(30) Foreign Application Priority Data

Feb. 25, 2013 (JP) ..... 2013-034382

(51) Int. Cl.
*H05G 2/00* (2006.01)
*G21K 5/00* (2006.01)

(52) U.S. Cl.
CPC . *H05G 2/008* (2013.01); *G21K 5/00* (2013.01)
USPC ..... 250/423 R; 250/504 R; 250/396 R; 250/492.3; 250/365; 250/298; 250/288; 250/492.2; 250/396 ML; 250/354.1

(58) Field of Classification Search
CPC ..... H05G 2/003; H05G 2/006; H05G 2/008; H05G 2/005; H01J 37/08; H01J 37/321; H01J 37/15; B01L 3/0268
USPC ..... 250/504 R, 423 R, 493.1, 365, 372, 250/396 R, 492.2, 492.3, 284, 288, 311, 250/354.1, 396 ML, 398, 428, 429, 492.1, 250/492.21, 503.1, 515.1
See application file for complete search history.

(56) References Cited

U.S. PATENT DOCUMENTS

| | | | | |
|---|---|---|---|---|
| 6,276,589 | B1 * | 8/2001 | Watts | 228/33 |
| 6,520,402 | B2 * | 2/2003 | Orme-Marmerelis et al. | 228/260 |
| 7,405,416 | B2 * | 7/2008 | Algots et al. | 250/493.1 |
| 7,872,245 | B2 * | 1/2011 | Vaschenko et al. | 250/492.2 |
| 8,242,474 | B2 * | 8/2012 | Nagai et al. | 250/504 R |
| 8,263,943 | B2 * | 9/2012 | Shichi et al. | 250/423 R |
| 8,581,220 | B2 * | 11/2013 | Ishihara et al. | 250/504 R |
| 8,604,451 | B2 * | 12/2013 | Yabu et al. | 250/504 R |
| 8,642,974 | B2 * | 2/2014 | Kellogg et al. | 250/423 R |
| 8,698,112 | B2 * | 4/2014 | Yabu et al. | 250/504 R |
| 8,742,378 | B2 * | 6/2014 | Kameda et al. | 250/504 R |
| 2005/0116985 | A1 * | 6/2005 | Schurenberg | 347/27 |
| 2006/0097151 | A1 * | 5/2006 | Seaward et al. | 250/288 |
| 2006/0192154 | A1 | 8/2006 | Algots et al. | |
| 2010/0200776 | A1 * | 8/2010 | Yabu et al. | 250/504 R |
| 2011/0174996 | A1 * | 7/2011 | Someya et al. | 250/504 R |
| 2011/0266465 | A1 * | 11/2011 | Shichi et al. | 250/492.3 |
| 2011/0310365 | A1 * | 12/2011 | Yabu et al. | 355/30 |
| 2013/0032640 | A1 * | 2/2013 | Yabu et al. | 239/13 |
| 2013/0146682 | A1 * | 6/2013 | Ishihara et al. | 239/590 |
| 2013/0175169 | A1 * | 7/2013 | Feiglin et al. | 204/450 |
| 2013/0277452 | A1 * | 10/2013 | Yabu et al. | 239/102.1 |

* cited by examiner

*Primary Examiner* — David A Vanore
(74) *Attorney, Agent, or Firm* — McDermott Will & Emery LLP

(57) ABSTRACT

A target supply device 4 may include a tank 51, formed of a metal, that holds a target material, an insulating member 62 that makes contact with at least part of the periphery of the tank 51, and a heater 58 that is separated from the tank 51 and heats the tank 51 via the insulating member 62.

7 Claims, 18 Drawing Sheets

TARGET SUPPLY DEVICE AND EXTREME ULTRAVIOLET LIGHT GENERATION APPARATUS

CROSS-REFERENCE TO A RELATED APPLICATION

The present application claims priority from Japanese Patent Application No. 2013-034382 filed Feb. 25, 2013.

BACKGROUND

1. Technical Field

The present disclosure relates to devices that supply a target irradiated with a laser beam for the purpose of generating extreme ultraviolet (EUV) light. The present disclosure also relates to apparatuses for generating extreme ultraviolet (EUV) light using such a target supply device.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A target supply device according to an aspect of the invention may include a tank, a nozzle, an insulating member, and a heater. The tank may be formed of a metal and may hold a target material. The nozzle may have a hole that communicates with the interior of the tank. The insulating member may make contact with at least part of the periphery of the tank. The heater may be separated from the tank and heat the tank via the insulating member.

BRIEF DESCRIPTION OF THE DRAWINGS

Hereinafter, selected embodiments of the present disclosure will be described with reference to the accompanying drawings.

DETAILED DESCRIPTION

Figure 1:
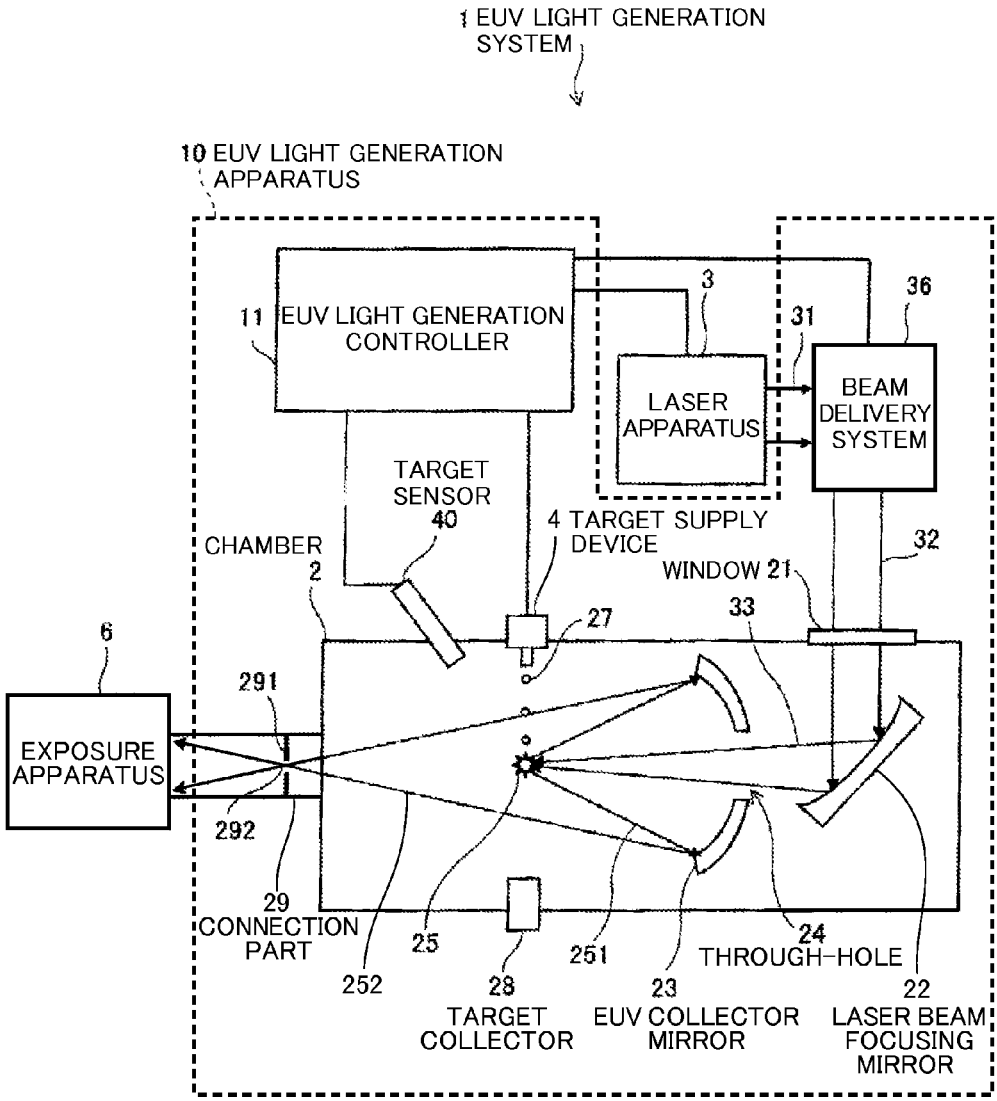
FIG. 1 schematically illustrates an exemplary configuration of an LPP type EUV light generation system 1.

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

Contents

1. Terms
2. Overview of Extreme Ultraviolet Light Generation Apparatus
2.1 Configuration
2.2 Operation
3. Extreme Ultraviolet Light Generation Apparatus Including Target Supply Device
3.1 Configuration
3.2 Operation
3.3 Issue
4. First Embodiment of Target Supply Device
4.1 Configuration
4.2 Operation
4.3 Effect
5. Second Embodiment of Target Supply Device
5.1 Configuration
5.2 Operation
5.3 Effect
6. Third Embodiment of Target Supply Device
6.1 Configuration
6.2 Operation
6.3 Effect

1. Terms

Several terms used in the present application will be described hereinafter. A "chamber" is a receptacle, in an LPP-type EUV light generation apparatus, that is used to isolate a space in which plasma is generated from the exterior. A "target supply device" is a device for supplying a target material that is used for generating EUV light, such as melted tin, to the interior of a chamber. An "EUV collector mirror" is a mirror for reflecting EUV light radiated from plasma and outputting that light to the exterior of a chamber.

2. Overview of EUV Light Generation System

2.1 Configuration

FIG. 1 schematically illustrates an exemplary configuration of an LPP type EUV light generation system. An EUV light generation apparatus 10 may be used with at least one laser apparatus 3. Hereinafter, a system that includes the EUV light generation apparatus 10 and the laser apparatus 3 may be referred to as an EUV light generation system 1. As shown in FIG. 1 and described in detail below, the EUV light generation apparatus 10 may include a chamber 2 and a target supply device 4. The chamber 2 may be sealed airtight. The target supply device 4 may be mounted onto the chamber 2, for example, to penetrate a wall of the chamber 2. A target material to be supplied by the target supply device 4 may include, but is not limited to, tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation apparatus 10 may further include an EUV light generation controller 11 and a target sensor 40. The target sensor 40 may have an imaging function and detect at least one of the presence, trajectory, position, and speed of a target 27.

Further, the EUV light generation apparatus 10 may include a connection part 29 for allowing the interior of the chamber 2 to be in communication with the interior of the exposure apparatus 6. A wall 291 having an aperture 293 may be provided in the connection part 29. The wall 291 may be positioned such that the second focus of the EUV collector mirror 23 lies in the aperture 293 formed in the wall 291.

The EUV light generation apparatus 10 may also include a beam delivery system 36, a laser beam focusing mirror 22, and a target collector 28 for collecting targets 27. The beam delivery system 36 may include an optical element (not separately shown) for defining the direction into which the pulse laser beam 32 travels and an actuator (not separately shown) for adjusting the position and the orientation or posture of the optical element.

2.2 Operation

With continued reference to FIG. 1, a pulse laser beam 31 outputted from the laser apparatus 3 may pass through the beam delivery system 36 and be outputted therefrom as the pulse laser beam. 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 4 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 11 may be configured to integrally control the EUV light generation system 1. The EUV light generation controller 11 may be configured to process image data of the target 27 captured by the target sensor 40. Further, the EUV light generation controller 11 may be configured to control at least one of: the timing when the target 27 is outputted and the direction into which the target 27 is outputted. Furthermore, the EUV light generation controller 11 may be configured to control at least one of: the timing when the laser apparatus 3 oscillates, the direction in which the pulse laser beam 33 travels, and the position at which the pulse laser beam 33 is focused. It will be appreciated that the various controls mentioned above are merely examples, and other controls may be added as necessary.

3. EUV Light Generation Apparatus Including Target Supply Device

3.1 Configuration

Next, the EUV light generation apparatus 10 including the target supply device 4 will be described.

Figure 2:
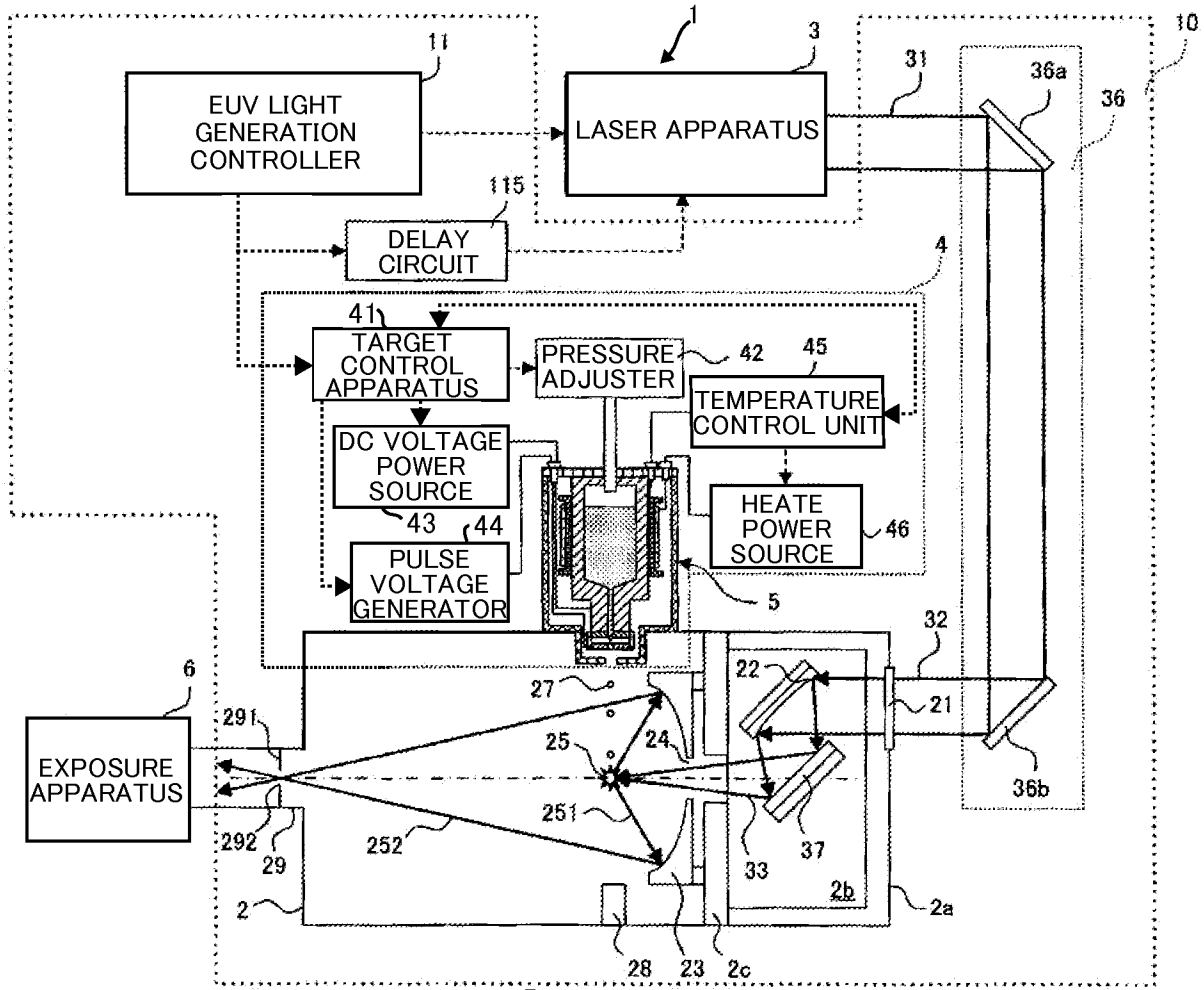
FIG. 2 is a diagram illustrating an EUV light generation system 1 according to an embodiment.

FIG. 2 is a diagram illustrating the EUV light generation apparatus 10 according to an embodiment.

As shown in FIG. 2, the EUV light generation apparatus 10 according to the present embodiment may include the chamber 2, the target supply device 4, a delay circuit 115, the EUV light generation controller 11, and the beam delivery system 36.

The chamber 2 may include a chamber main body 2*a*, a first support member 2*b*, and a second support member 2*c*. The window 21, the laser beam focusing mirror 22, the EUV collector mirror 23, the target collector 28, and a flat mirror 37 may be disposed in the chamber 2.

A target supply section 5 included in the target supply device 4, the window 21, and the target collector 28 may be provided in the chamber main body 2*a*. The laser beam focusing mirror 22 and the flat mirror 37 may be disposed in the first support member 2*b*. The EUV collector mirror 23 may be disposed in the second support member 2*c*. The beam delivery system 36 may include optical elements 36*a* and 36*b* that define a direction in which a laser beam travels. The optical elements 36*a* and 36*b* may be connected to an actuator (not shown) for adjusting the positions or orientations thereof.

Note that the delay circuit 115 may be configured within the EUV light generation controller 11.

3.2 Operation

Next, operations performed by the EUV light generation apparatus 10 including the target supply device 4 will be described.

The EUV light generation controller 11 may send a control signal for outputting the target 27 to the target supply device 4. In the case where a trajectory of the target 27 is stable within a predetermined range, the EUV light generation controller 11 may output a trigger signal synchronized with the output of the target 27 to the laser apparatus 3 via the delay circuit 115. The delay circuit 115 may delay the trigger signal by a predetermined amount of time. The delay time of the trigger signal may be set so that the pulse laser beam 33 strikes the target 27 when the target 27 arrives at the plasma generation region 25.

Referring to FIG. 2, a pulse laser beam 31 outputted from the laser apparatus 3 may traverse the beam delivery system 36, the laser beam focusing mirror 22, and the flat mirror 37, and may strike at least one target 27 as the pulse laser beam 33.

The target 27 may be outputted from the target supply device 4 toward the plasma generation region 25. The target 27 irradiated with the pulse laser beam 33 can be turned into plasma, and the EUV light 251 can be radiated from that plasma. The EUV light 251 may be outputted to the exposure apparatus 6 via the EUV collector mirror 23.

3.3 Issue

Next, an issue in the EUV light generation apparatus 10 including the target supply device 4 will be described using an example for reference.

Figure 3:
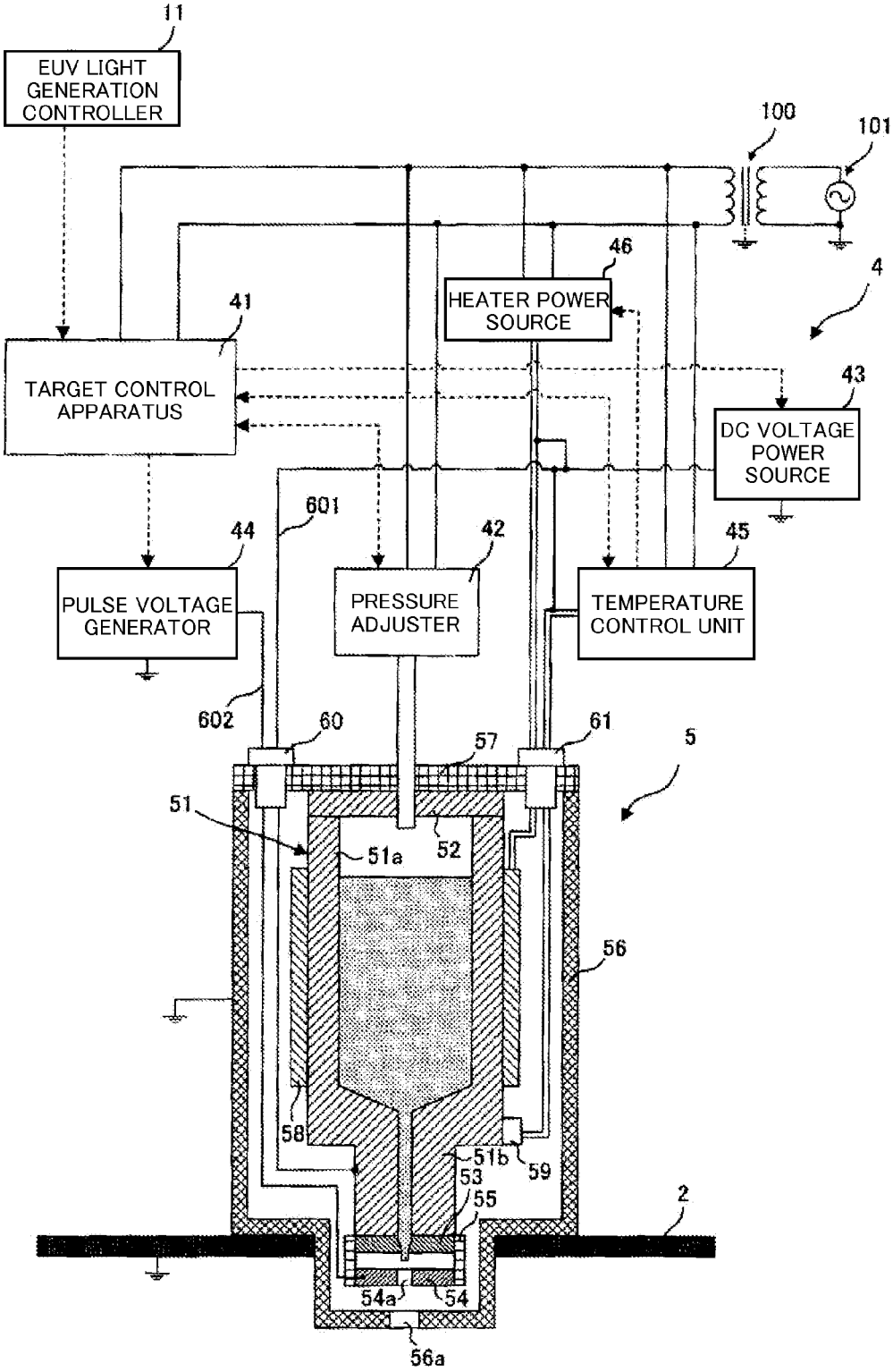
FIG. 3 is a diagram illustrating an issue with a target supply device 4 using an example for reference.

FIG. 3 is a diagram illustrating an issue with the target supply device 4 using an example for reference.

The target supply device 4 according to the example for reference may include a target control apparatus 41, a pressure adjuster 42, a DC voltage power source 43, a pulse voltage generator 44, a temperature control unit 45, a heater power source 46, and the target supply section 5.

The target supply section 5 may include a tank 51, a tank cover 52, a nozzle 53, an extraction electrode 54, an electrode support member 55, a case 56, a case cover 57, a heater 58, a temperature sensor 59, a voltage inlet terminal 60, and a relay terminal 61.

The target supply device 4 according to this example for reference may output liquid tin in the form of a droplet. The tin may be held in the tank 51 at a temperature that is higher than the melting point of tin (231.9° C.). Accordingly, the tank 51 may be heated to a predetermined temperature by the heater 58. The predetermined temperature may be, for example, 250° C. to 300° C.

To discharge the liquid tin in the form of a droplet, a potential difference of 10 kV to 20 kV relative to the chamber 2 may be applied to the tank 51. In this case, it is desirable for the tank 51 and the heater 58 to be electrically insulated.

In the target supply device 4 according to the example for reference, the heater 58 and the temperature sensor 59 may be installed directly at the tank 51. In order to suppress breakdown from occurring between the tank 51 and the heater 58 and between the tank 51 and the temperature sensor 59, the heater power source 46 connected to the heater 58 and the temperature control unit 45 connected to the temperature sensor 59 may be connected to an output of the DC voltage power source 43.

Because the heater power source 46 and the temperature control unit 45 are connected to the DC voltage power source 43, it is preferable for the power for driving the heater power source 46 and the temperature control unit 45 to be supplied in an indirect state isolated from a commercial power outlet. Accordingly, the heater power source 46 and the temperature control unit 45 may, for example, be connected to an AC 100V power source 101 via an insulation transformer 100. In other words, the target supply device 4 may be electrically insulated as a whole from a ground potential by the insulation transformer 100.

However, electrically insulating the target supply device 4 as a whole using the insulation transformer 100 requires that the existing device is insulated as a whole, which may require a large amount of effort, time, and incur high costs.

4. First Embodiment of Target Supply Device 4.1 Configuration

Next, the target supply device 4 according to a first embodiment will be described.

Figure 4:
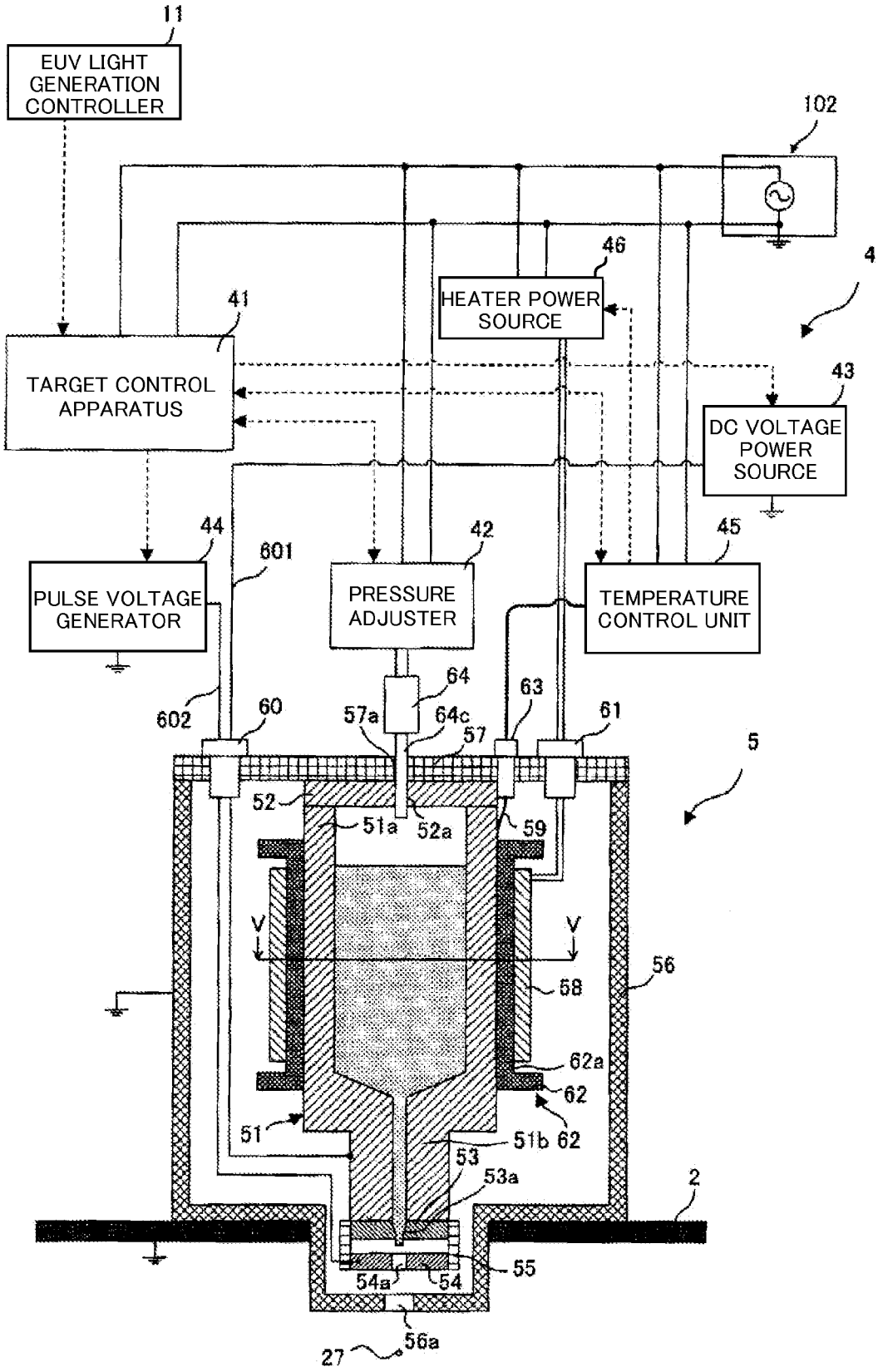
FIG. 4 illustrates a target supply device 4 according to a first embodiment.
Figure 5:
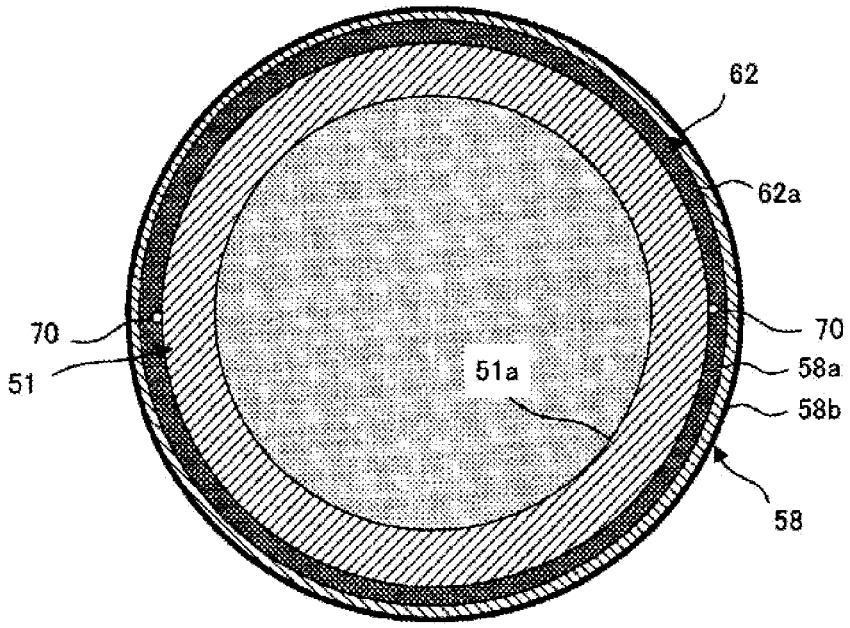
FIG. 5 is a cross-sectional view taken along a V-V line in FIG. 4.

FIG. 4 illustrates the target supply device 4 according to the first embodiment. FIG. 5 is a cross-sectional view taken along a V-V line in FIG. 4.

The target supply device 4 according to the first embodiment may include the target control apparatus 41, the pressure adjuster 42, the DC voltage power source 43, the pulse voltage generator 44, the temperature control unit 45, the heater power source 46, the target supply section 5, and a power source 102.

The target supply section 5 may include the tank 51, the tank cover 52, the nozzle 53, the extraction electrode 54, the electrode support member 55, the case 56, the case cover 57, the heater 58, the temperature sensor 59, a high-voltage inlet terminal 60, the relay terminal 61, an insulating member 62, and a temperature sensor terminal 63.

The tank 51 may be formed of molybdenum (Mo) or tungsten (W), which does not easily react with liquid tin (Sn). The tank 51 may include a tank portion 51*a* that defines a space in which the tin is stored, and a channel portion 51*b* that is formed below the tank portion 51*a* and defines a channel having a smaller diameter than the space in the tank portion 51*a*. An end area of the tank portion 51*a* may be sealed by the tank cover 52.

The tank cover 52 may be formed of molybdenum or tungsten, which do not easily react with liquid tin. A first pressure adjustment hole 52*a* may be formed in the tank cover 52. A metal tube 64*c* that is connected to the pressure adjuster 42 may be inserted into the first pressure adjustment hole 52*a*.

The nozzle 53 may be provided in a leading end of the channel portion 51*b*. The material of the nozzle 53 may be molybdenum or tungsten. A nozzle hole 53*a* may be formed in the nozzle 53.

The nozzle hole 53*a* may be connected to the channel defined by the channel portion 51*b*. The nozzle hole 53*a* may have a circular cross-section. The nozzle hole 53*a* may have a shape in which the diameter thereof decreases as the nozzle hole 53*a* progresses downward from the channel portion 51*b*. The diameter of a leading end of the nozzle hole 53*a* may be several μm to 10 μm. A piezoelectric element (not shown) may be attached to the nozzle 53.

The extraction electrode 54 may be disposed on the nozzle 53 with the electrode support member 55 interposed therebetween. A target passing-hole 54*a* may be formed in the extraction electrode 54. The target passing-hole 54*a* may be disposed downstream from the nozzle hole 53*a* in the direction in which the targets travel. The nozzle 53 and the extraction electrode 54 may be insulated from each other by the electrode support member 55.

The temperature sensor 59 may include an optical fiber connected to the temperature control unit 45. Part of the temperature control unit 45 and the optical fiber may function as an optical fiber thermometer. A sensor through-hole 70 may be formed between the tank portion 51*a* and the insulating member 62. The optical fiber may be disposed in the sensor through-hole 70, so as to serve as the temperature sensor 59. A plurality of optical fibers may be present, and may be disposed at a plurality of locations in the tank 51 via a plurality of sensor through-holes 70. The temperature control unit 45 may measure a temperature at a location in the tank 51 where the leading end of the optical fiber is disposed.

The tank 51, the tank cover 52, the nozzle 53, the extraction electrode 54, the electrode support member 55, the heater 58, the temperature sensor 59, and the insulating member 62 may be housed within the case 56. The case 56 may be disposed in the chamber 2. The case 56 may be configured of a conductive member. A through-hole 56*a* may be formed in the case 56. The through-hole 56*a* may be disposed downstream from the nozzle hole 53*a* and the target passing-hole 54*a* in the direction in which targets travel.

The case cover 57 may be disposed on one end of the case 56. A second pressure adjustment hole 57*a* may be formed in the case cover 57. The case cover 57 may be configured of an electrically insulative material. The metal tube 64*c* that is connected to the pressure adjuster 42 may be inserted into the second pressure adjustment hole 57*a*. The case 56 and the chamber 2 may be grounded.

The target control apparatus 41 may be connected to the pressure adjuster 42, the DC voltage power source 43, the pulse voltage generator 44, and the temperature control unit 45. The temperature control unit 45 may be connected to the heater power source 46.

The DC voltage power source 43 may be connected to the tank 51 via a high-voltage cable 601. The pulse voltage generator 44 may be connected to the extraction electrode 54 via a high-voltage cable 602. The heater power source 46 may be connected to the heater 58. The power source 102 may be a three-phase 100 V power source, and may be connected to the target control apparatus 41, the pressure adjuster 42, the temperature control unit 45, and the heater power source 46.

Figure 6:
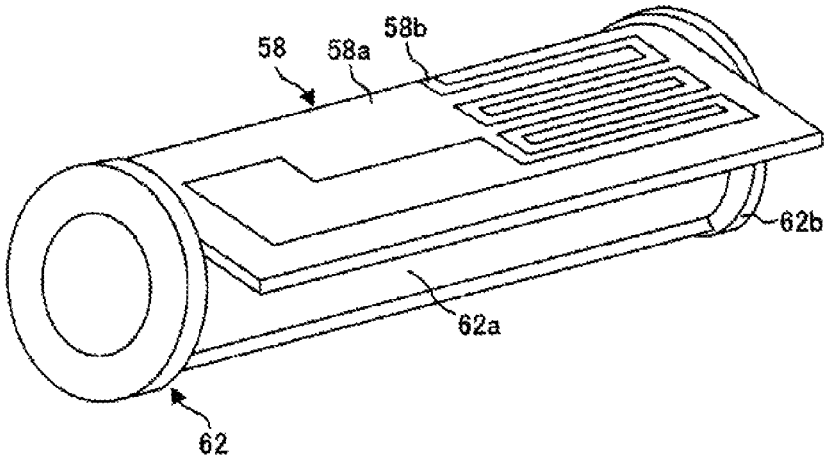
FIG. 6 illustrates a heater 58 wrapped around an insulating member 62 according to the first embodiment.

FIG. 6 illustrates the heater 58 wrapped around the insulating member 62 in the target supply device 4 according to the first embodiment.

The insulating member 62 may be configured of a ceramic material such as alumina ceramics. The insulating member 62 may include a contact portion 62*a* whose inner surface makes contact with at least part of an outer circumferential surface of the tank 51, and a protruding portion 62*b* formed in an end of the contact portion 62*a* and protruding away from the tank 51.

The heater 58 may include a flexible insulating sheet 58*a* configured of a ceramic material such as alumina ceramics, and a heating wire 58*b* formed of a metal such as tungsten or molybdenum. The heater 58 may be wrapped around an outer circumference of the contact portion 62*a* of the insulating member 62, with the heating wire 58*b* located on the outside. The heater 58 and the insulating member 62 may then be fired. In other words, the heating wire 58*b* of the heater 58 may be disposed around the periphery of the tank 51, in a state where the heating wire 58*b* is exposed on the outside of the insulating member 62 and the insulating sheet 58*a*.

Note that the heater 58 may be wrapped around the tank 51 directly without using the insulating member 62. In other words, the heater 58 may be disposed around the periphery of the tank 51 so that the insulating sheet 58*a* makes contact with the tank 51. In addition, the heater 58 may be disposed so that the heating wire 58*b* is exposed on the outside of the insulating sheet 58*a*. In this case, the insulating sheet 58*a* may configure the insulating member.

Figure 7:
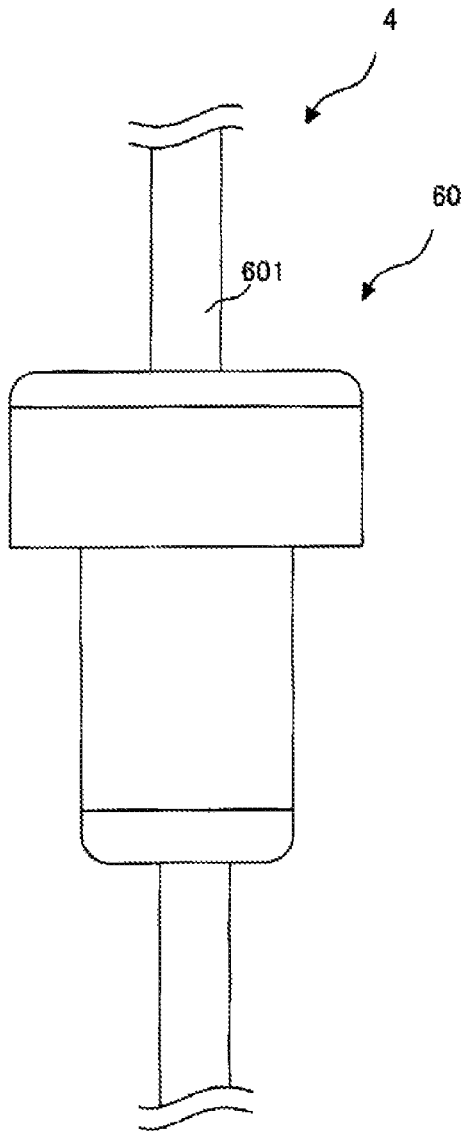
FIG. 7 illustrates a high-voltage inlet terminal 60 in a target supply device 4 according to an embodiment.

FIG. 7 illustrates the high-voltage inlet terminal 60 according to an embodiment.

As shown in FIG. 4, terminal holes may be formed in the case cover 57. The high-voltage inlet terminal 60, the relay terminal 61, and the temperature sensor terminal 63 may be inserted into the terminal holes. The high-voltage inlet terminal 60 may have a structure in which a conductor to which the high-voltage cable 601 is connected at both ends is passed through an insulating material, formed of a ceramic material such as alumina, that configures an outer layer. The outside insulating material of the high-voltage inlet terminal 60 may be fixed to the case cover 57 and the high-voltage cable 601 in an airtight state. The relay terminal 61 and the temperature sensor terminal 63 may have the same structure as the high-voltage inlet terminal 60.

Figure 8:
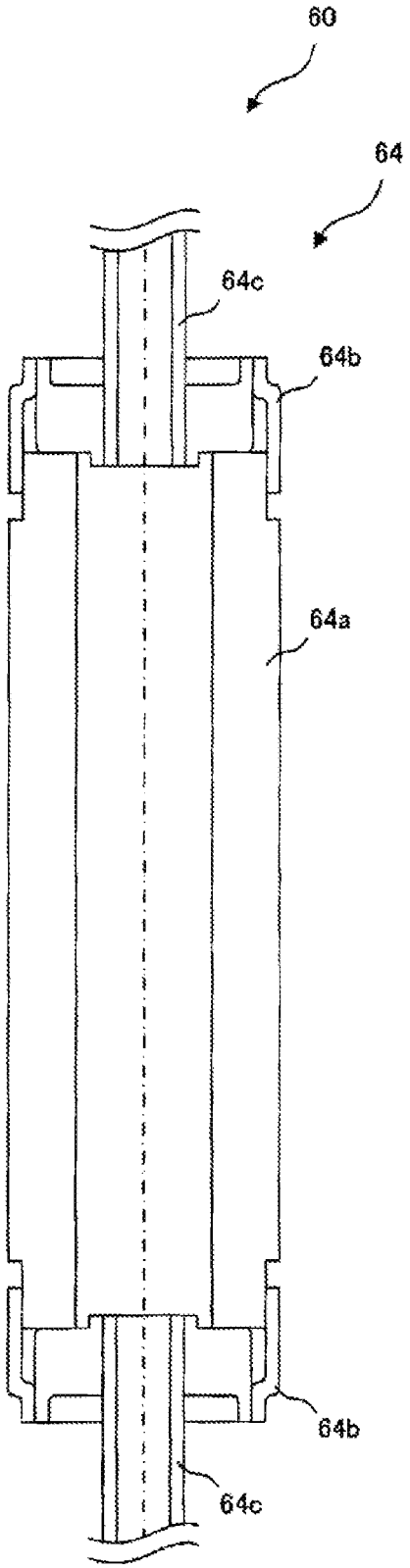
FIG. 8 illustrates an electrical insulator coupling 64 in a target supply device 4 according to an embodiment.

FIG. 8 illustrates an electrical insulator coupling 64 according to this embodiment.

The electrical insulator coupling 64 may include a ceramic tube 64*a* formed of a ceramic material such as alumina, and a tube coupling 64*b*, configured of stainless steel or the like, that connects the ceramic tube 64*a* and the metal tube 64*c* in an airtight state. The ceramic tube 64*a* and the tube coupling 64*b* may be fixed to each other in an airtight state through soldering using a metal such as silver. The electrical insulator coupling 64 may be disposed in at least part of the metal tube 64*c* that connects the pressure adjuster 42 and the tank 51, as shown in FIG. 4.

4.2 Operation

Next, operations of the target supply device 4 will be described.

The target control apparatus 41 may send control signals to the pressure adjuster 42, the DC voltage power source 43, the pulse voltage generator 44, and the temperature control unit 45 based on signals sent from the EUV light generation controller 11. The target control apparatus 41 may receive control signals from the pressure adjuster 42 and the temperature control unit 45. The temperature control unit 45 may send a control signal to the heater power source 46.

The target control apparatus 41 may receive a target generation signal from the EUV light generation controller 11.

The target control apparatus 41 may send a signal specifying a target temperature to the temperature control unit 45 so that the temperature of the tin (Sn) in the tank 51 reaches a predetermined temperature greater than the melting point of tin (232° C.) (for example, approximately 250° C.)

The temperature control unit 45 may receive, from the temperature sensor 59, a signal indicating a temperature in the tank 51 measured by the temperature sensor 59. The temperature control unit 45 may send a signal specifying power to be supplied to the heater 58 to the heater power source 46, based on the signal from the temperature sensor 59.

In this manner, the temperature control unit 45 may control various constituent elements so that the tank 51 reaches the target temperature specified by the target control apparatus 41. The temperature control unit 45 may send, to the target control apparatus 41, a signal indicating the temperature of the tank 51 measured by the temperature sensor 59 as a signal expressing a state of control.

The target control apparatus 41 may send a signal indicating a target pressure to the pressure adjuster 42, so that the tin in the tank 51 is pressurized to a predetermined pressure. The predetermined pressure may be 1 to 10 MPa. The pressure adjuster 42 may receive a signal indicating the pressure within the tank 51 from a pressure sensor provided therein. The pressure adjuster 42 may be connected to an inert gas bottle (not shown), and may be configured to supply inert gas depressurized from the bottle to the interior of the tank 51. Based on the signal from the pressure sensor, the pressure adjuster 42 may adjust the pressure of the inert gas supplied to the tank 51 using a supply valve and an exhaust valve provided therein. A signal indicating the pressure in the tank 51 measured by the pressure sensor may be sent to the target control apparatus 41 as a signal expressing a state of control.

The target control apparatus 41 may control the DC voltage power source 43 and the pulse voltage generator 44 so that a potential between the tank 51 and the extraction electrode 54 reaches a predetermined potential (for example, 20 kV).

Thereafter, the target control apparatus 41 may send, to the EUV light generation controller 11, a signal indicating that preparation for generating targets is complete. The target control apparatus 41 may receive a trigger signal for generating the targets from the EUV light generation controller 11.

The target control apparatus 41 may control the pulse voltage generator 44 to apply a pulse potential of a predetermined pulse duration at a predetermined repetition rate to the extraction electrode 54 in synchronization with the received trigger signal. The predetermined repetition rate may be 100 kHz, for example, and the predetermined pulse may have a duration of 1 to 2 μs, for example. Furthermore, the potential applied to the extraction electrode 54 may be a potential that changes from 20 kV, to 15 kV, to 20 kV, for example.

When the pulse potential is applied, the liquid tin in the tank 51 may be drawn out from the nozzle hole 53*a* by a static electricity force produced by a potential difference between the tank 51 and the extraction electrode 54. The liquid tin that has been drawn out from the nozzle hole 53*a* may remain for a while in the nozzle hole 53*a* due to surface tension. After this, an electrical field may concentrate on the drawn-out liquid tin, and the static electricity force may increase further. When the static electricity force exceeds the surface tension, the liquid tin may separate from the nozzle hole 53*a*, forming a positively-charged target 27. Thereafter, the target 27 may pass through the target passing-hole 54*a* in the extraction electrode 54.

4.3 Effect

Next, effects of the target supply device 4 will be described.

The heater 58 may be disposed around the periphery of the tank 51 with the insulating member 62 interposed therebetween, and the heater 58 and the tank 51 may be insulated from each other. According to this configuration, it is not necessary to supply power to a power source line of the heater 58 via an insulation transformer. The heater power source 46 may be directly connected to the three-phase 100 V power source 102.

The heating wire 58*b* of the heater 58 is disposed around the periphery of the tank 51, in a state where the heating wire 58*b* is exposed on the outside of the insulating member 62 and the insulating sheet 58*a*; wiring can be performed after the device is assembled, and thus the wiring may be performed with ease. Note that the insulating sheet 58*a* may be used by itself as the insulating member.

The temperature control unit 45 and the tank 51 may be insulated from each other by using an optical fiber as the temperature sensor 59. According to this configuration, it is not necessary to supply power to a power source line of the temperature control unit 45 via an insulation transformer. The temperature control unit 45 may be directly connected to the three-phase 100 V power source 102.

The insulating member 62 is formed of the contact portion 62*a* that makes contact with the tank 51 and the protruding portion 62*b* that protrudes from an end area of the contact portion 62*a*, and thus the creeping distance between the tank 51 and the heater 58 can be increased.

5. Second Embodiment of Target Supply Device

5.1 Configuration

Next, the target supply device 4 according to a second embodiment will be described.

Figure 9:
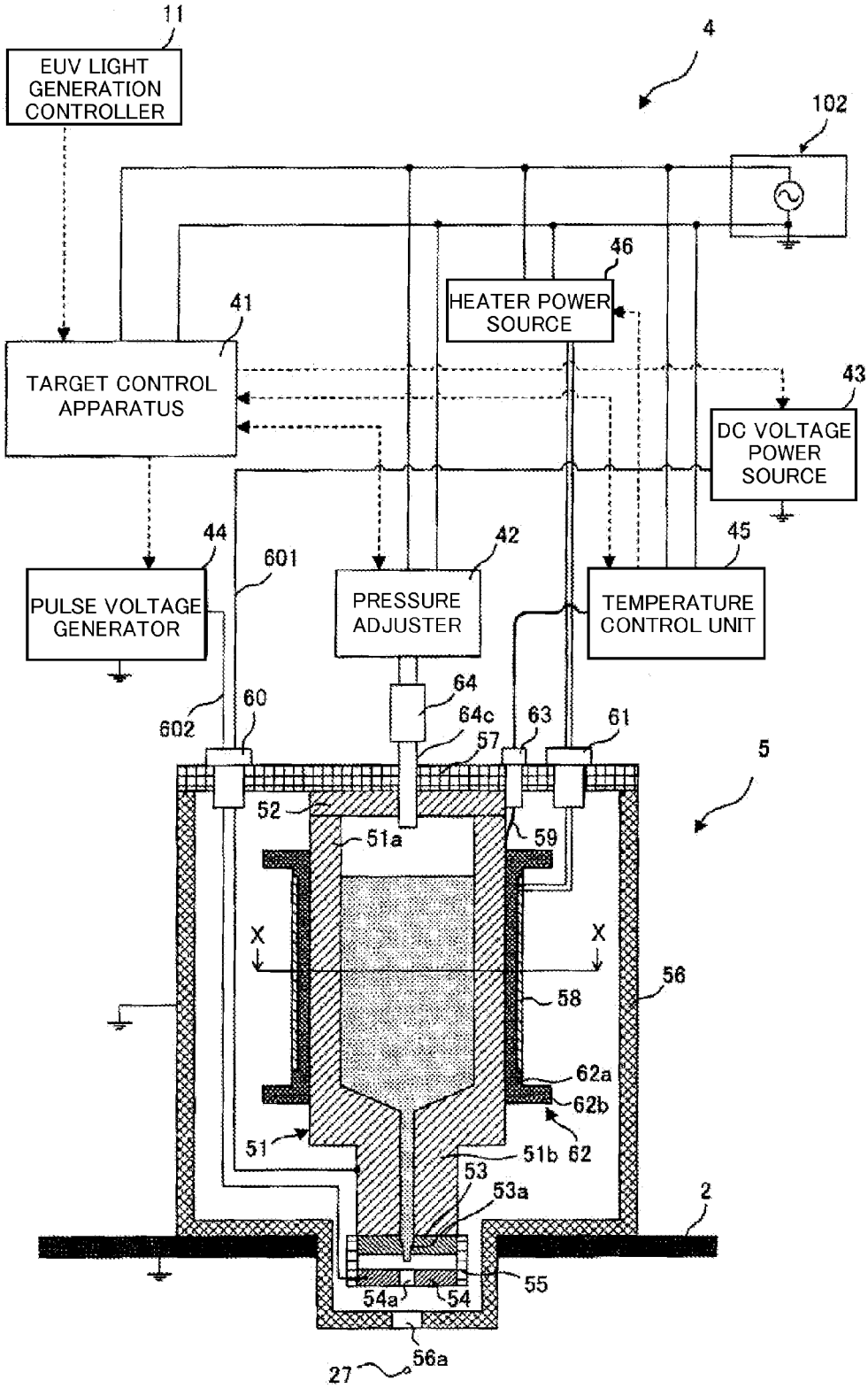
FIG. 9 illustrates a target supply device 4 according to a second embodiment.
Figure 10:
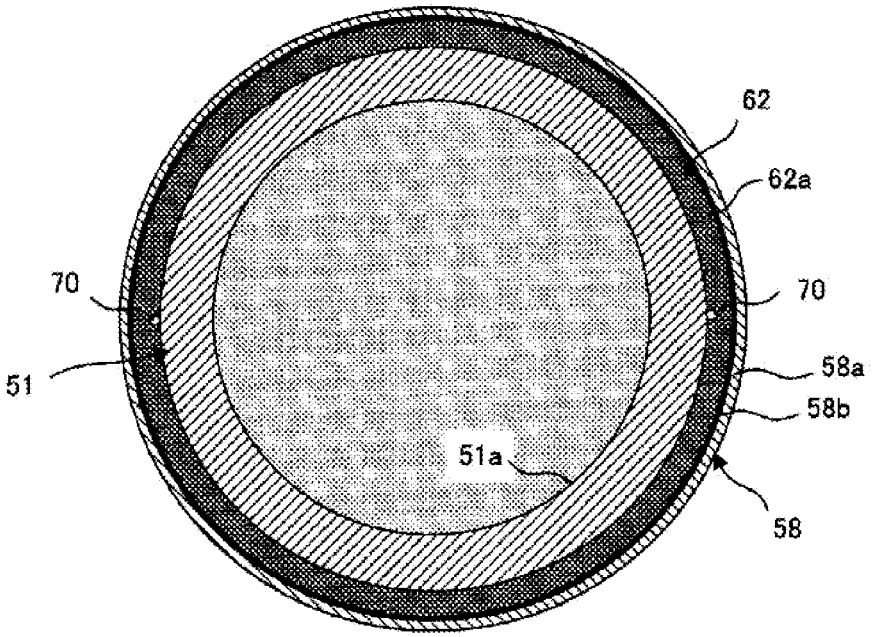
FIG. 10 is a cross-sectional view taken along an X-X line in FIG. 9.

FIG. 9 illustrates the target supply device 4 according to the second embodiment. FIG. 10 is a cross-sectional view taken along an X-X line in FIG. 9.

In the target supply device 4 according to the second embodiment, the heater 58 of the target supply section 5 may be disposed so that the heating wire 58*b* makes contact with the insulating member 62 and the insulating sheet 58*a* is disposed on the outside of the heating wire 58*b*. The configuration may be the same as in the first embodiment in other respects.

Figure 11:
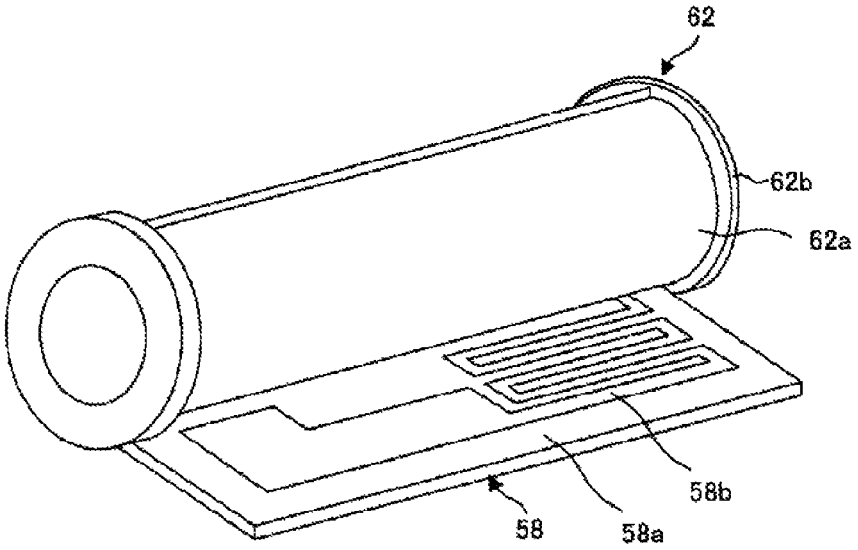
FIG. 11 illustrates a heater 58 wrapped around an insulating member 62 in the target supply device 4 according to the second embodiment.

FIG. 11 illustrates the heater 58 wrapped around the insulating member 62 in the target supply device 4 according to the second embodiment.

The heater 58 may include the insulating sheet 58*a* formed of an insulating member configured of a ceramic material such as alumina ceramics, and the heating wire 58*b* formed of a metal such as tungsten or molybdenum. The heater 58 may be wrapped around an outer circumference of the contact portion 62*a* of the insulating member 62, with the heating wire 58*b* located on the inside. The heater 58 and the insulating member 62 may then be fired. In other words, the heating wire 58*b* of the heater 58 may be disposed around the periphery of the tank 51, in a state where the heating wire 58*b* is interposed between the insulating sheet 58*a* and the insulating member 62.

5.2 Operation

Next, operations of the target supply device 4 according to the second embodiment will be described. Note that in the following, descriptions of operations identical to those in the first embodiment will be omitted.

The temperature control unit 45 may send a signal specifying power to be supplied to the heater 58 to the heater power source 46, based on the signal from the temperature sensor 59. The heater power source 46 may cause the heater 58 to emit heat by supplying power to the heater 58. The heater 58 may heat the tank 51 via the insulating member 62 so that the liquid tin in the tank 51 reaches a predetermined temperature (for example, 250° C.)

5.3 Effect

The heating wire 58*b* of the heater 58 may be disposed around the periphery of the tank 51, in a state where the heating wire 58*b* is interposed between the insulating sheet

58*a* and the insulating member 62, and thus the insulating sheet 58*a* can suppress the radiation of heat from the heating wire 58*b*.

The heating wire 58*b* of the heater 58 is not exposed to the peripheral area, and thus a rise in the temperature of the elements in the periphery of the heater 58 can be suppressed. Furthermore, because the heating wire 58*b* is not exposed to the peripheral area, the occurrence of problems such as short-circuits and the like can be reduced, which in turn makes it possible for the heater 58 to operate in a stable manner.

6. Third Embodiment of Target Supply Device

6.1 Configuration

Next, the target supply device 4 according to a third embodiment will be described.

Figure 12:
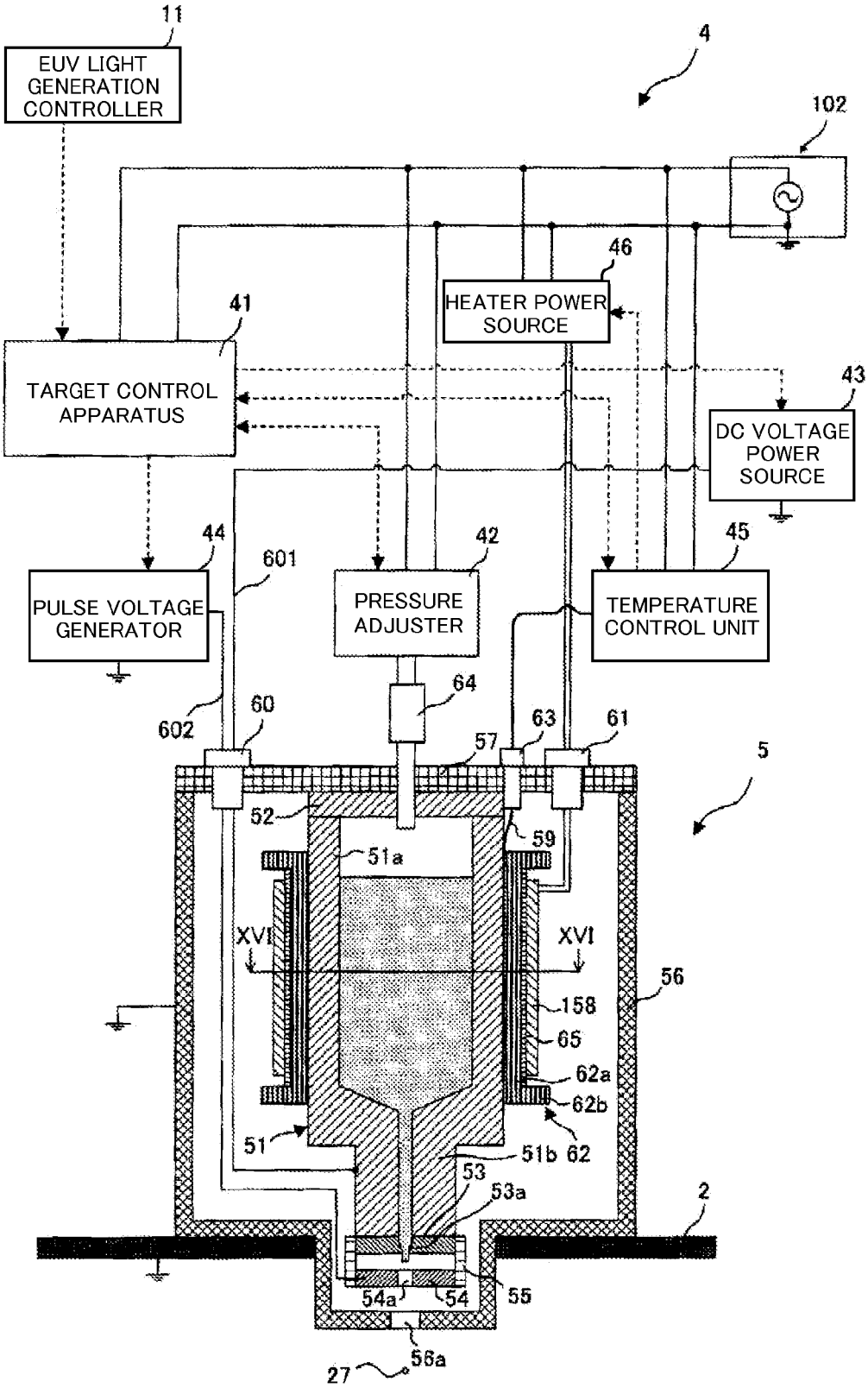
FIG. 12 illustrates a target supply device 4 according to a third embodiment.
Figure 13:
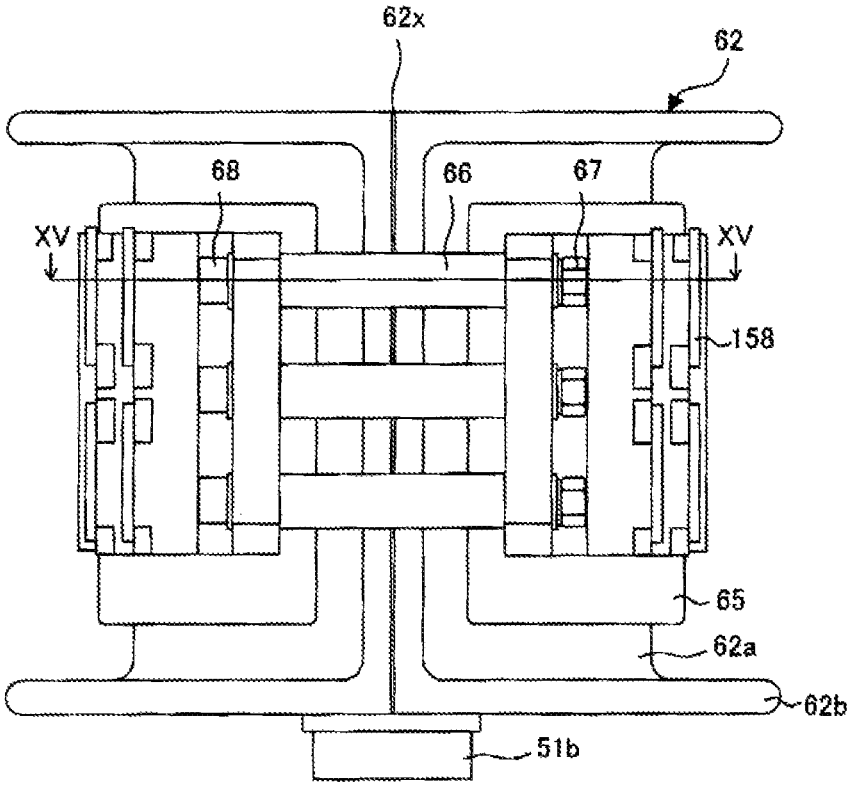
FIG. 13 illustrates an insulating member and a heater in the target supply device 4 according to the third embodiment.
Figure 14:
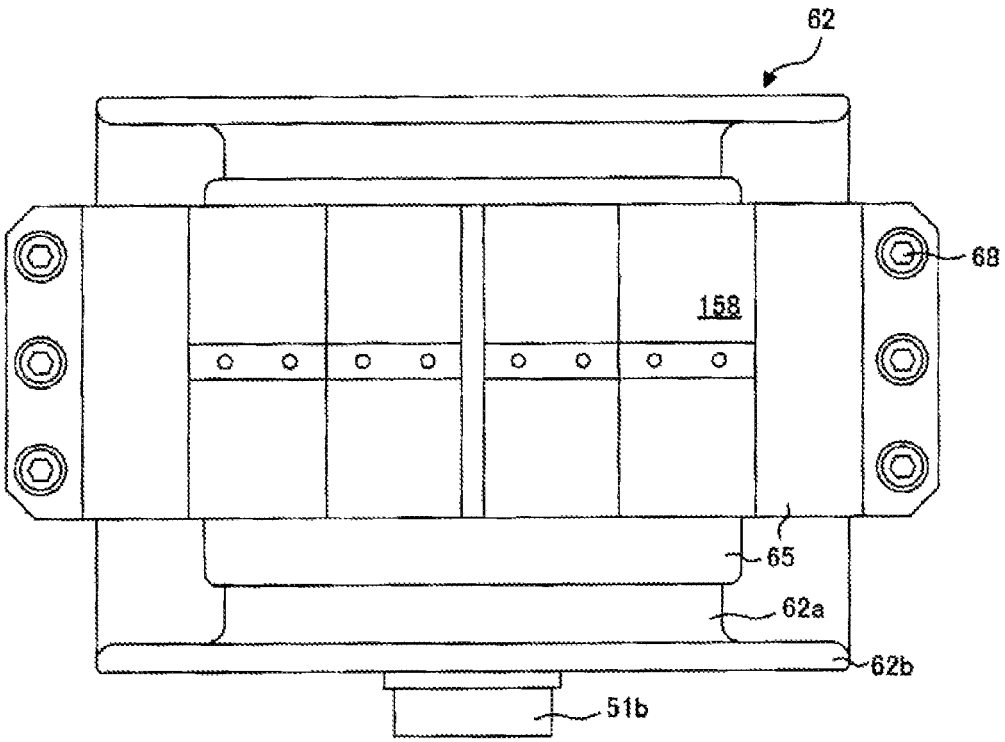
FIG. 14 illustrates the details of FIG. 13 from a different angle.
Figure 15:
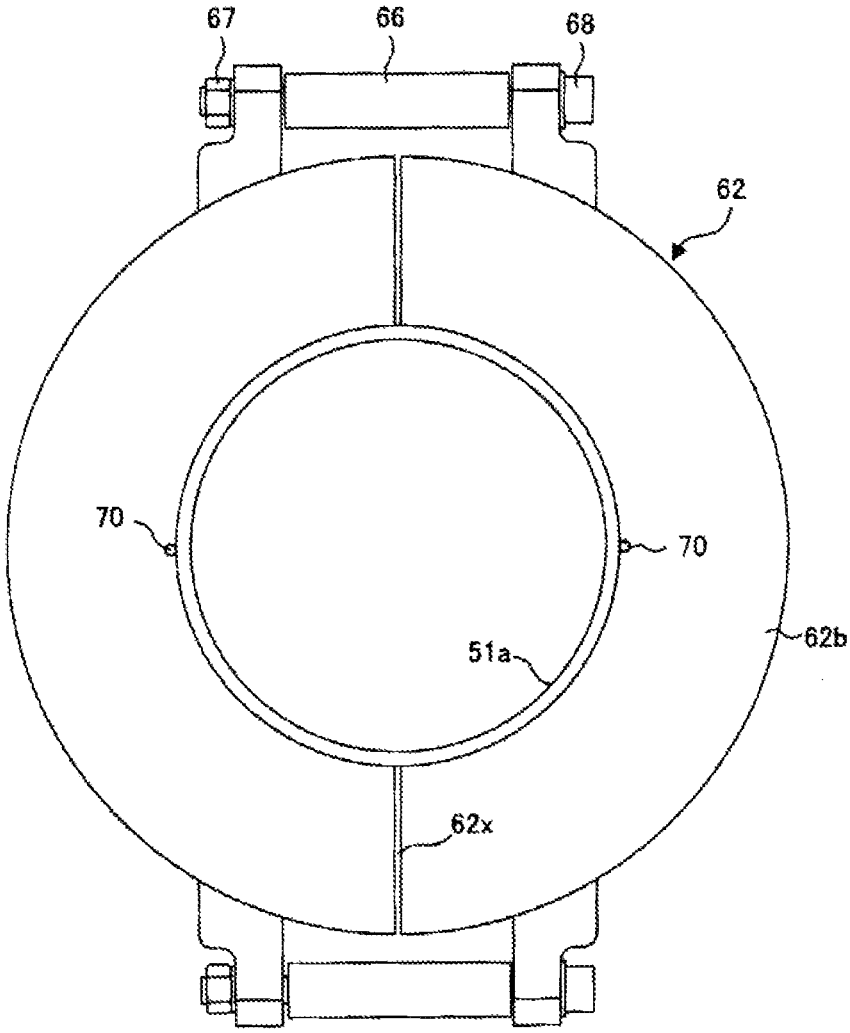
FIG. 15 illustrates the details of FIG. 13 from above.
Figure 16:
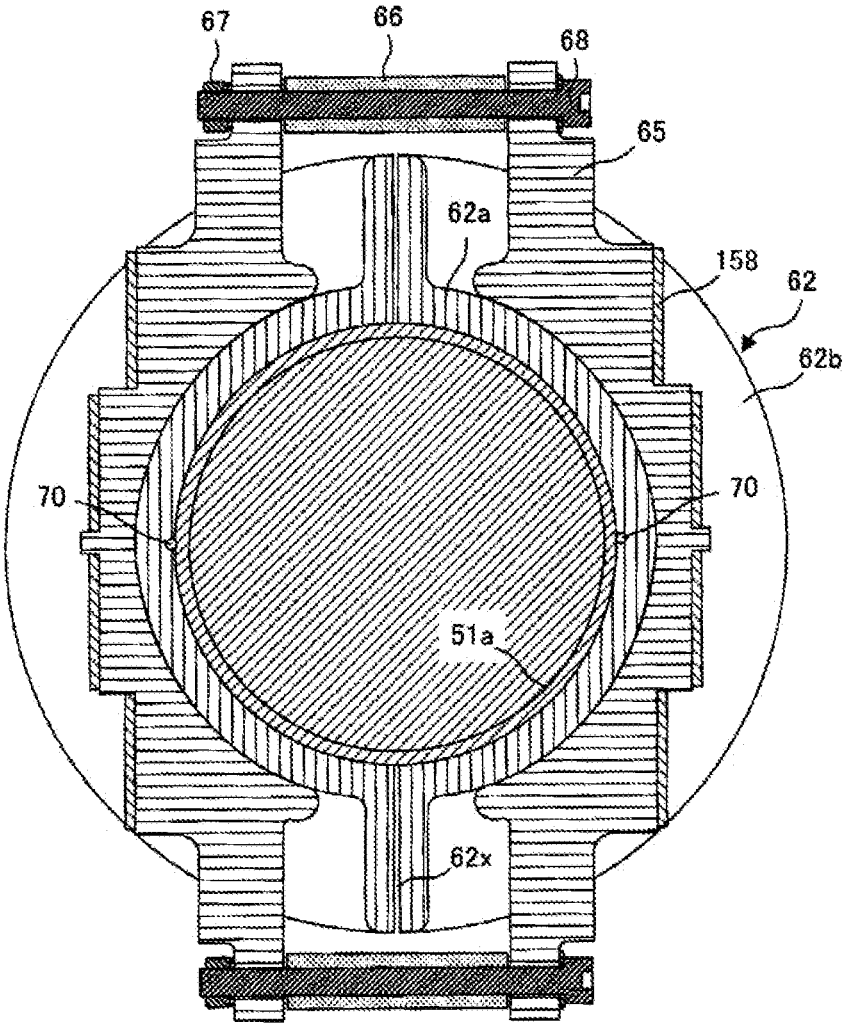
FIG. 16 is a cross-sectional view taken along an XVI-XVI line in FIG. 12 and FIG. 13.

FIG. 12 illustrates the target supply device 4 according to the third embodiment. FIG. 13 illustrates insulating members 62 and heaters 158 according to the third embodiment. FIG. 14 illustrates the details of FIG. 13 from a different angle. FIG. 15 illustrates the details of FIG. 13 from above. FIG. 16 is a cross-sectional view taken along an XVI-XVI line in FIG. 12 and FIG. 13.

In the target supply device 4 according to the third embodiment, jackets 65 may be disposed between the heaters 158 and the insulating members 62 in the target supply section 5. In the third embodiment, descriptions of configurations identical to those in the first embodiment will be omitted.

The insulating members 62 may be disposed around the periphery of the tank 51, and may be provided as at least two parts in the circumferential direction. The separate insulating members 62 may be disposed so that a gap 62*x* is formed therebetween.

The jackets 65 may also be provided as at least two parts that correspond to the respective insulating members 62, and may be disposed so as to make contact with at least part of the outer circumference of the insulating members 62. The jackets 65 may be configured of a metal having a high thermal conductivity. For example, the jackets 65 may be configured of copper (Cu). The jackets 65 provided as at least two parts may be connected using bolts 68 and nuts 67 so as to sandwich the tank 51 and the insulating members 62 therebetween.

The heaters 158 may be disposed on an outer surface of corresponding jackets 65. The heaters 158 may have a plate shape, or may have a sheet shape as described in the first embodiment and the second embodiment. The heaters 158 may be ceramic heaters, for example. At least two heaters 158 may be disposed. Note that harnesses connected to the heaters 158 are not shown in FIG. 13 to FIG. 16.

Figure 17:
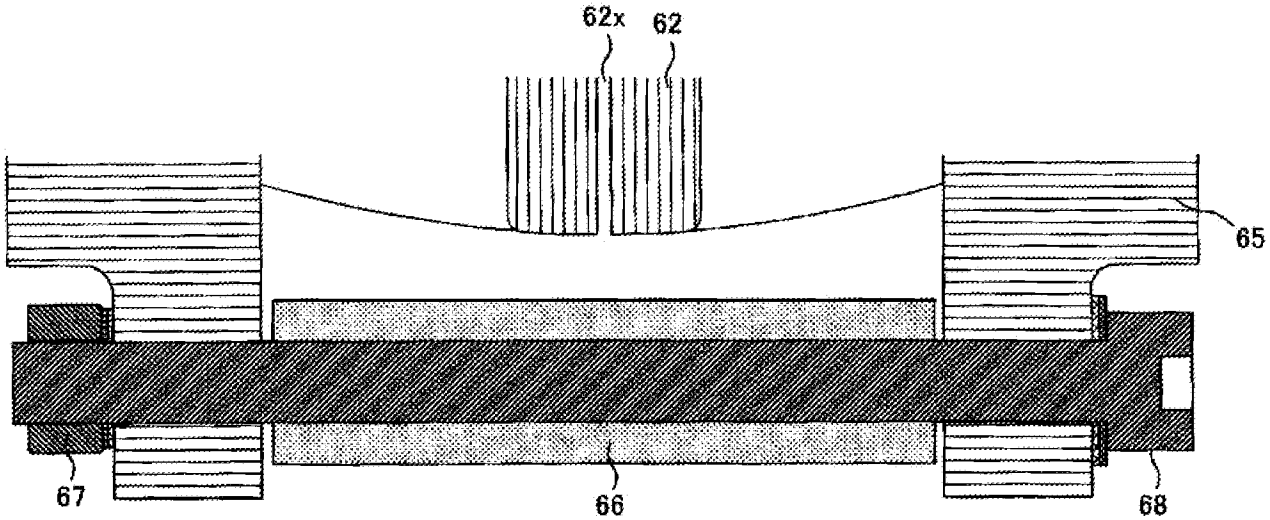
FIG. 17 illustrates an area where jackets 65 are linked in the target supply device 4 according to the third embodiment.
Figure 18:
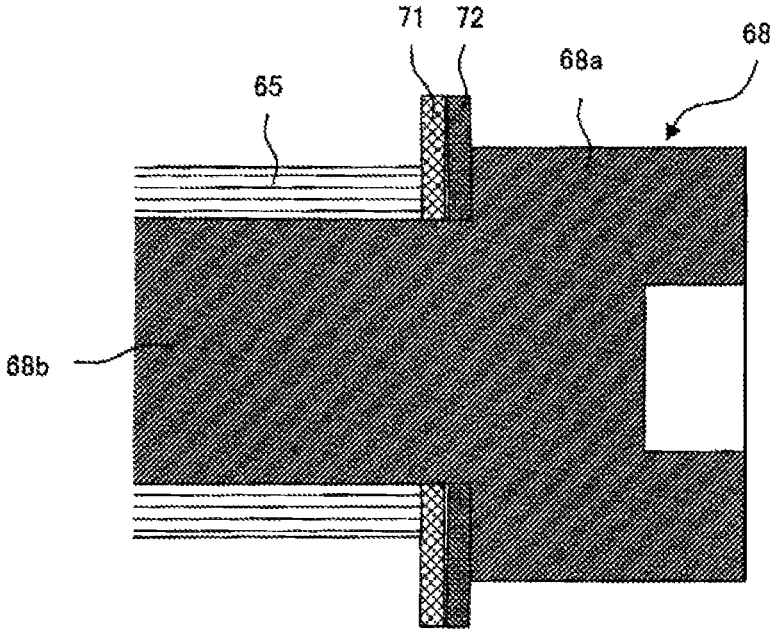
FIG. 18 is an enlarged view of the vicinity of a bolt head in the target supply device 4 according to the third embodiment.

FIG. 17 illustrates an area where the jackets 65 are linked in the target supply device 4 according to the third embodiment. FIG. 18 is an enlarged view of the vicinity of a bolt head in the target supply device 4 according to the third embodiment.

The bolt 68 may include a bolt head 68*a* and a screw portion 68*b*. Part of the screw portion 68*b* between the jackets 65 may be sheathed in a ceramic tube 66. A flat washer 71 and a spring washer 72 serving as an elastic member may be disposed between the bolt head 68*a* and the jacket 65. The flat washer 71 and the spring washer 72 serving as an elastic member may be disposed between the nuts 67 and the jacket 65.

6.2 Operation

Next, operations of the target supply device 4 according to the third embodiment will be described. Note that in the following, descriptions of operations identical to those in the first embodiment will be omitted.

The temperature control unit 45 may send a signal specifying power to be supplied to the heaters 158 to the heater power source 46, based on the signal from the temperature sensor 59. The heater power source 46 may cause the heaters 158 to emit heat by supplying power to the heaters 158. The heaters 158 may heat the tank 51 via the jackets 65 and the insulating members 62 so that the liquid tin in the tank 51 reaches a predetermined temperature (for example, 250° C.)

When the heaters 158 emit heat and the liquid tin in the tank 51 is heated to the predetermined temperature, the tank 51, the insulating members 62, and the jackets 65 may thermally expand. The thermal expansion coefficients of the tank 51, the insulating members 62, and the jackets 65 may fulfill a relationship of $\beta_T<\beta_I<\beta_J$. Here, $\beta_T$ represents the thermal expansion coefficient of the tank 51, $\beta_I$ represents the thermal expansion coefficient of the insulating members 62, and $\beta_J$ represents the thermal expansion coefficient of the jackets 65.

The thermal expansion coefficients of the tank 51, the insulating members 62, and the jackets 65 according to this embodiment are indicated below.

thermal expansion coefficient $\beta_T$ of tank 51 (molybdenum): $5.2\times10^{-6}$ thermal expansion coefficient $\beta_I$ of insulating members 62 (alumina): $7.7\times10^{-6}$ thermal expansion coefficient $\beta_J$ of jackets 65 (copper): $16.6\times10^{-6}$ The tank 51, the insulating members 62, and the jackets 65 may have different thermal expansion coefficients. Because the gap 62*x* is formed between the at least two insulating members 62, an amount of deformation occurring when the insulating members 62 thermally expand may be absorbed by the gap 62*x* contracting. When the jackets 65 thermally expand, the amount of deformation produced thereby may be absorbed by the spring washers 72 elastically deforming.

6.3 Effect

When the insulating members 62 thermally expand, the insulating members 62 expand so that the gap 62*x* is closed, and thus surface contact can be maintained between the tank 51 and the insulating members 62. In addition, when the jackets 65 thermally expand, the spring washers 72 elastically deform and absorb the expansion, and thus surface contact can be maintained between the jackets 65 and the insulating members 62.

Accordingly, the different thermal expansion coefficients of the tank 51, the insulating members 62, and the jackets 65 make it possible to maintain surface contact therebetween while suppressing contact problems during heating, and furthermore the heat produced by the heaters 158 can be efficiently transferred to the tank 51 via the jackets 65 and the insulating members 62.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. A target supply device comprising:

a tank, formed of a metal, configured to hold a target material;

a nozzle including a hole that communicates with the interior of the tank;

an insulating member configured to make contact with at least part of the periphery of the tank; and a heater that is separated from the tank and is configured to heat the tank via the insulating member.

2. The target supply device according to claim 1, wherein the insulating member is formed of at least two insulating members disposed so that a gap is defined therebetween;

the target supply device further includes a jacket configured to hold the at least two insulating members in contact with the tank; and the heater is disposed on the jacket.

3. The target supply device according to claim 2, wherein the jacket is configured of at least two members, and the target supply device further includes:

a fastening member configured to fasten the at least two members together; and an elastic member disposed between the jacket and the fastening member.

4. The target supply device according to claim 2, wherein thermal expansion coefficients of the tank, the insulating member, and the jacket fulfill a relationship $\beta_T<\beta_I<\beta_J$, where $\beta_T$ represents the thermal expansion coefficient of the tank, $\beta_I$ represents the thermal expansion coefficient of the insulating member, and $\beta_J$ represents the thermal expansion coefficient of the jacket.

5. The target supply device according to claim 2, wherein the insulating member includes:

a contact portion that makes contact with the tank; and a protruding portion that protrudes from an end area of the contact portion.

6. The target supply device according to claim 1, further comprising:

an insulating sheet disposed around the outer circumference of the heater.

7. An extreme ultraviolet light generation apparatus that generates extreme ultraviolet light by irradiating a target material with a laser beam introduced from the exterior, the apparatus comprising:

a chamber into which the laser beam is introduced; and a target supply device configured to supply the target material to the interior of the chamber, the target supply device including:

a tank, formed of a metal, configured to hold a target material;

a nozzle including a hole that communicates with the interior of the tank;

an insulating member configured to make contact with at least part of the periphery of the tank; and a heater that is separated from the tank and is configured to heat the tank via the insulating member.

* * * * *